US008864550B2

(12) United States Patent
Gleeson et al.

(10) Patent No.: US 8,864,550 B2
(45) Date of Patent: Oct. 21, 2014

(54) UPLIFT BRA

(75) Inventors: Carolyn Patricia Gleeson, Auckland (NZ); Verina Garvey, Auckland (NZ)

(73) Assignee: Trifinity Limited, Auckland (NZ)

( * ) Notice: Subject to any disclaimer, the term of this patent is extended or adjusted under 35 U.S.C. 154(b) by 184 days.

(21) Appl. No.: 13/302,383

(22) Filed: Nov. 22, 2011

(65) Prior Publication Data

US 2012/0129430 A1 May 24, 2012

Related U.S. Application Data

(63) Continuation-in-part of application No. 11/661,256, filed as application No. PCT/NZ2005/000229 on Aug. 31, 2005, now abandoned.

(51) Int. Cl.
*A41C 3/00* (2006.01)

(52) U.S. Cl.
CPC ..... *A41C 3/0021* (2013.01)
USPC ..... 450/60; 450/64

(58) Field of Classification Search
USPC ..... 450/59–66, 70, 72, 85, 86
See application file for complete search history.

(56) References Cited

U.S. PATENT DOCUMENTS

| | | | | | |
|---|---|---|---|---|---|
| 2,156,478 | A | * | 5/1939 | Kemp | 450/85 |
| 2,255,720 | A | * | 9/1941 | Lewis | 450/86 |
| 2,486,414 | A | * | 11/1949 | Sayers | 450/59 |
| 2,611,130 | A | * | 9/1952 | Engelman | 450/30 |
| 4,470,419 | A | | 9/1984 | DiTullio | 450/19 |
| 5,167,566 | A | * | 12/1992 | Novitsky et al. | 450/74 |
| 5,823,851 | A | * | 10/1998 | Dicker | 450/2 |
| 6,213,842 | B1 | | 4/2001 | Degirmenci | 450/71 |
| 6,896,581 | B2 | * | 5/2005 | Otto | 450/59 |
| 6,896,582 | B2 | * | 5/2005 | Kawami | 450/86 |
| 6,918,812 | B2 | | 7/2005 | Giese | 450/65 |

FOREIGN PATENT DOCUMENTS

| | | |
|---|---|---|
| WO | WO02/15727 | 2/2002 |
| WO | WO02/43515 | 6/2002 |
| WO | WO2004/019711 | 3/2004 |

* cited by examiner

*Primary Examiner* — Gloria Hale
(74) *Attorney, Agent, or Firm* — Jacobson Holman, PLLC.

(57) ABSTRACT

The bra comprises a breast containment zone defined by two breast cups engaged to a perimeter element. The perimeter element has a base and two peripheral sides extending from each side of the base, forming a "U" shape that extends about each breast cup. A chest band is engaged to and extends bilaterally away from each breast cup, to encompass the torso of a wearer. The chest band has a lower elongate zone to apply a first force to the perimeter element at the base of the perimeter element, and an upper elongate zone to apply a second force adjacent each breast cup to the perimeter element at the each peripheral side of the perimeter element and at a distance away from the base of the perimeter element.

18 Claims, 11 Drawing Sheets

UPLIFT BRA

This application is a Continuation-in-Part Application of U.S. patent application Ser. No. 11/661,256, filed Sep. 26, 2007, now abandoned, which is a national stage application of PCT/NZ2005/000229, filed Aug. 31, 2005 and published in English, which claims priority to New Zealand application 535036 filed Aug. 31, 2004, which is incorporated by reference herein.

FIELD OF THE INVENTION

The present invention relates to a bra.

BACKGROUND

A wide range of bras have been produced that aim to provide a basic level of support and to achieve aesthetic outcomes in relation to shape and the appearance of the bra itself. In a typical fabric bra uplift and shaping is provided through two key structural aspects; a harness or frame which provides location of the bra on the hard tissue of the torso relative to the shoulder line and breast line and a pair of fabric cups attached to the frame that individually encapsulate the soft tissue of each breast. Further positioning and shaping of each breast can be provided through the use of an underwire within the frame of the bra.

With a traditional fabric bra, support is provided by repositioning the breast relative to the body of the wearer and influencing the shape of the breast through the application of a flexible boundary in the form of a fabric cup.

Positioning of the breast above its natural position is termed uplift. With a traditional fabric bra uplift is often achieved by tensioning the shoulder strap of the bra, such that the cup is drawn upwards and the breast is compressed into the body. An alternative method to achieve upward displacement of the breast is to provide inserts in the lower portion of the bra cup.

When uplift is achieved by shortening of the shoulder strap, tension is transferred to the bra cup to reduce the degree of overlap of the lower breast tissue over the torso of the wearer below the breasts.

With a traditional fabric bra the resulting shape of the breast, being one of the fundamental aesthetic outcomes, is a function of a number of variables: volume of the breast, the degree of tension in the cup to achieve desired uplift, the shape and construction of the flexible fabric cup, the design of the bra harness or frame. As the optimum position of the breast is particular to an individual it is intuitive that the degree of uplift and resulting shape may be different for each individual wearer of a particular bra. This issue contributes to significant challenges of 'fit' and sizing in the industry together with implications for wearer comfort.

Typical fabric bra cups are thermally moulded into a near-hemispherical shape during manufacture. This shape does not provide inherent uplift when the bra is being worn and additional adjustment, through tensioning of the shoulder straps is required. Tensioning of the shoulder straps can cause discomfort and longer-term issues.

A bra of a common configuration is for example shown in FIG. 1*a*. It is shown in a lay flat condition. The bra consists of two breast cups. Extending from each breast cup is a chest band. Over the shoulder straps extend between each cup and a respective chest band.

In the lay flat condition this common form of bra has its chest bands projecting from each breast cup, at an angle to each other. When such a bra is worn, the chest bands are lifted (in a direction shown by the arrows) so that the chest bands extend substantially in a horizontal plane about the body of a wearer.

Uplift of the bra may be desired to change the visual appearance of the breasts. In addition to carrying a load relating to pulling up of the chest bands, the shoulder straps may carry additional loading to uplift the bra. This may increase the undesired loading on the shoulders of a wearer and dependent on the nature of the bra, a tightening of the shoulder straps to create uplift may not always work. Furthermore, whilst a tightening of the shoulder straps may create uplift, it may also result in other adverse effects.

With reference to FIG. 1*b* there is shown a front view of part of a bikini top. There is shown two breast cups of a substantially triangular plan shape. FIG. 1*b* illustrates on the right hand cup, a force F being applied by the shoulder strap to the cup. In cross section the cup, when worn, may have a shape as shown in the right hand cross section shown in FIG. 1*b*. Should a person wish to increase cleavage, the shoulder straps may be tightened. On the left hand side a tightened shoulder strap is shown wherein the force applied by the shoulder strap is higher than the force on the right hand side. The corresponding cross section shows the cup is much flatter as a result. Whilst it may create cleavage, this also increases the pressure on the shoulders. This may also create undesired cup shaping or breast shaping.

An increase in the shoulder strap force is also likely to result in lifting of the bra which may result in the bra riding up to an extent that is undesirable.

In these prior art forms of bra, each breast is individually controlled for shape by each breast cup separately, this means that shaping and sizing of each breast cup needs to be accurate to a specific person's breast size in order to provide comfortable support and uplift. But a bra is not always the perfect shape and size for a person, unless it's a custom made bra and hence the prior art forms of bra do not provide a great deal of forgiveness where an incorrect bra size or shape is being worn.

Accordingly it is an object of the present invention to provide a bra that addresses the abovementioned disadvantages or that will at least provide the public with a useful choice.

BRIEF DESCRIPTION OF THE INVENTION

In a first aspect the present invention may be said to be a bra that comprises:

a breast containment zone that is defined by two breast cups that are engaged to a perimeter element, the perimeter element comprising a base perimeter and two peripheral sides perimeters extending from each side of the base and forming a "U" shape that extends about the base perimeter and side perimeter of each breast cup, an elongate chest band that is engaged to and extends bilaterally away from the perimeter element at each breast cup, to encompass the torso of a wearer, the chest band comprising:

(a) an lower elongate zone to apply a first force to said perimeter element in a direction parallel to a transverse plane of the body of the wearer at the base of the perimeter element, and (b) an upper elongate zone to apply a second force adjacent each breast cup to said perimeter element in a direction parallel to a transverse plane of the body of the wearer at the each peripheral side of the perimeter element and at a distance away from said base of the perimeter element, wherein each breast cup includes a line of inelasticity that extends:

i. from where said second force is applied to said breast cup, ii. to the base of the perimeter element.

Preferably each perimeter element is engaged, at an upper end of each of its peripheral sides, to an over the shoulder strap.

Preferably the upper most part of each breast cup terminates at an upper end of each peripheral side of the perimeter element.

Preferably the upper elongate zone terminates at each said peripheral side of the perimeter element at where the upper most part of each breast cup is engaged to said perimeter element.

Preferably the "U" shaped element is a perimeter band.

Preferably the lower zone is a lower perimeter of the chest band that preferably extends parallel to said transverse plane, at least at said base of said perimeter element, and preferably entirely along said base's entire length.

Preferably the upper zone is an upper perimeter of the chest band.

Preferably the chest band is resilient to forces applied thereto by virtue of breast weight carried by the cup at which the chest band is engaged.

Preferably the chest band is inelastic.

Preferably the chest band is made from a resiliently stretchable material.

Preferably the upper and lower zones of the chest band are joined by material extending in between.

Preferably the material extending in between is inelastic or resiliently stretchable.

Preferably the upper zone is not linear but is capable of applying said second force in a direction parallel to the transverse plane.

Preferably the lower elongate perimeter of the chest band engages to the perimeter element tangentially.

Preferably each breast cup includes a. a lower perimeter region engaged to the base of said perimeter element, b. a side perimeter region engaged to a peripheral side of the perimeter element, and c. a neckline perimeter region, the neckline perimeter region extends between i. a first distal end (inner end) of the lower perimeter region (or proximate thereto) and ii. a first distal end (upper end) of the side perimeter region, wherein the lower perimeter region and side perimeter region are coterminous each other.

Preferably for each breast cup, the second end of the lower perimeter region is located at less than half way from the inner end to a point on the lower perimeter region of the chest band at which a normal thereof lies in a plane that extends through the upper end.

Preferably each breast cup has at least one line of inelasticity that extends preferably across each breast cup, but alternatively defining the neckline, such line extending from the base of said perimeter element to a peripheral side of said perimeter element.

Preferably said cup line has a normal that defines a line of symmetry of at least that part of said cup that is located between said cupline and the perimeter element.

Preferably the cupline is the lowest cupline of the cup.

Preferably the normal to the cupline that is the line of symmetry projects from the cupline towards the sagittal plane of the wearer when the cup is worn.

Preferably the normal also projects upwardly.

Preferably each breast cup has a plurality of lines of inelasticity that extend across each breast cup, such lines radiating from the base of said perimeter element to a peripheral side of said perimeter element.

Preferably a notional line between (a) the location of where the upper edge of the chest band is engaged to the perimeter element and (b) the bra midpoint at the perimeter element, has a normal that defines a line of symmetry of at least that part of said cup that is located between said notional line and the perimeter element.

Preferably the chest band comprised of two parts each part extending from a respective breast cup to a free distal end at where a fastener is located to fasten with the fastener of the other chest band.

Preferably the chest band comprises a plurality of upper inelastic zones that each extend to apply a force parallel to said first mentioned second force to said perimeter element.

Preferably each said force applied to said perimeter element by said plurality of upper inelastic zones occurs at a location commensurate where a line of inelasticity of said breast cup is provided.

Preferably the upper perimeter of each chest band extends parallel to the lower perimeter of the chest band, save for at the end of the upper perimeter line extending away from the breast cup.

Preferably the lower perimeter of chest band extends continuously adjacent the lower perimeter element.

Preferably the upper perimeter of the chest band, at each peripheral side, joins to said perimeter element at a respective shoulder strap.

Preferably each breast cup includes a lower perimeter region, a side perimeter region and a neckline perimeter region.

Preferably the neckline perimeter region extends between a first distal end (inner end) of the lower perimeter region (or proximate thereto) and a first distal end (upper end) of the side perimeter region.

Preferably the lower perimeter region and side perimeter region are joined to each other.

Preferably the lower perimeter region and side perimeter region define a non apexed perimeter line of the breast cup between said inner end and upper end.

Preferably the lower perimeter region and side perimeter region define a continuously curved when viewed front-on) perimeter line of the breast cup between said inner end and upper end.

Preferably the perimeter line between the upper end and the inner end includes a curved section (when viewed front-on).

Preferably the lower perimeter region of each breast cup extends parallel to the lower perimeter of a respective chest band.

Preferably the lower perimeter region of each breast cup is contiguous the lower perimeter of a respective chest band.

Preferably the lower perimeter region of each breast cup is parallel the other when the bra is in its lie flat condition.

Preferably the lower perimeter region of each breast cup has a second distal end that is in horizontal alignment with the inner end of said lower perimeter.

Preferably the second distal end of the lower perimeter region is contiguous the lower perimeter of a respective chest band.

Preferably the other distal end of the side perimeter region is located contiguous the lower perimeter of a respective chest band.

Preferably the other distal end is located at the second distal end of the lower perimeter region.

Preferably from the other distal end toward the upper end, the distance from the lower perimeter region of a respective chest band to the side perimeter region increases.

Preferably the second end of the lower perimeter region is located at no less than half way from the inner end to a point on the lower perimeter of the chest band at which a normal thereof lies in a plane that extends through the upper end.

Preferably the second end of the lower perimeter region is located at less than anywhere between 50% to 75% of the distance from the inner end to a point on the lower perimeter of the chest band at which a normal thereof extends through the upper end.

Preferably said cupline of inelasticity extends to define one side of a triangle of a triangulation of forces, when views from a posterior direction towards the wearer, extending between:

(a) the first end of the lower perimeter region of the breast cup and the upper end of the side perimeter region of the breast cup, and (b) the first end of the lower perimeter region of the breast cup and the second end thereof, and (c) the second end of the lower perimeter region of the breast cup and upper end of the side perimeter region.

Preferably the cupline extends along the one side of the triangle.

Preferably at least one cupline is provided extending at least in part across said breast cup.

Preferably said at least one cupline extends between the first end of the lower perimeter region and the upper end of the side perimeter region.

Preferably there are two cup lines, located one on each side of a notional line extending between the first end of the lower perimeter region and the upper end of the side perimeter region.

Preferably there are a plurality of cuplines that each extend to define said one side of the triangle.

Preferably said cupline resists elongation of the cupline but may not be resistant to out of plane or curve bending.

Preferably the or each cupline is defined at least in part by stitching.

Preferably the or each cupline is defined by a rigidification of the breastcup (whether it is part of all of one of all of any multiply assembly of the breastcup).

Preferably the bra includes two over the shoulder straps that each extend between a respective breast cup and the or a respective chest band.

Preferably each over the shoulder strap engages each breast cup at the upper end of the side perimeter region.

Preferably the shoulder straps engage to the perimeter element at each cup in a manner to be directionally continuous with perimeter element when seen from in front of a wearer of the bra.

Preferably the shoulder straps project in a direction parallel to the sagittal plane of the wearer.

Preferably the cup shape of each breast cup is defined by moulding process.

Preferably the cup line(s) are defined by stitching extending through at least one of the plies.

Preferably the bra is a non-underwire bra.

Preferably no part of each cup extends below the base of the perimeter element.

Preferably the distance between (a) a notional point on the lower perimeter of the chest band and (b) a point at which the upper inelastic zone engages said perimeter element, along a line normal to the lower perimeter region, is no less than 50% of the distance between (a) said notional point and (b) a point on the lower perimeter of the chest band that is located midway the base of said perimeter element.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

Where reference herein is made to aspects of shape and geometry and orientation it refers predominantly to so such when the bra is in a lay flat condition as shown for example in FIG. 1*d*.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

BRIEF DESCRIPTION OF THE DRAWINGS

Preferred forms of the present invention will now be described with reference to the accompanying drawings in which.

DETAILED DESCRIPTION OF THE INVENTION

Figure 1A:
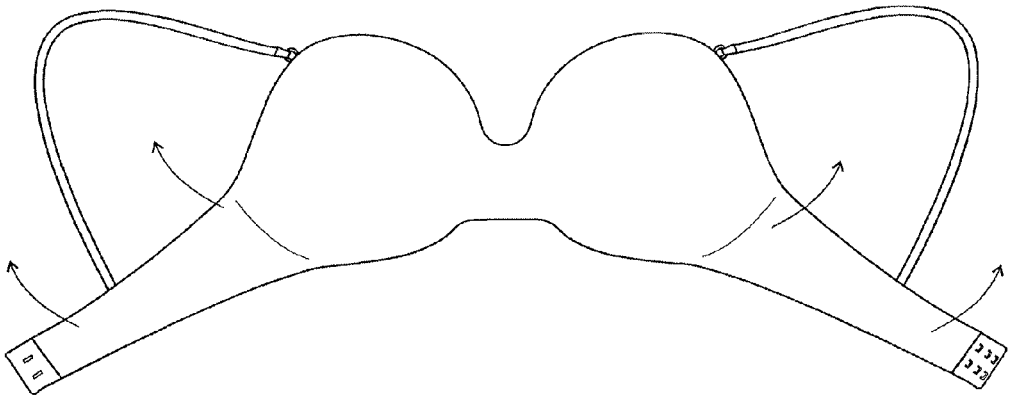
FIGURE 1a (Prior Art)
FIG. 1*a* is a drawing of a prior art bra in a lay flat condition.
Figure 1B:
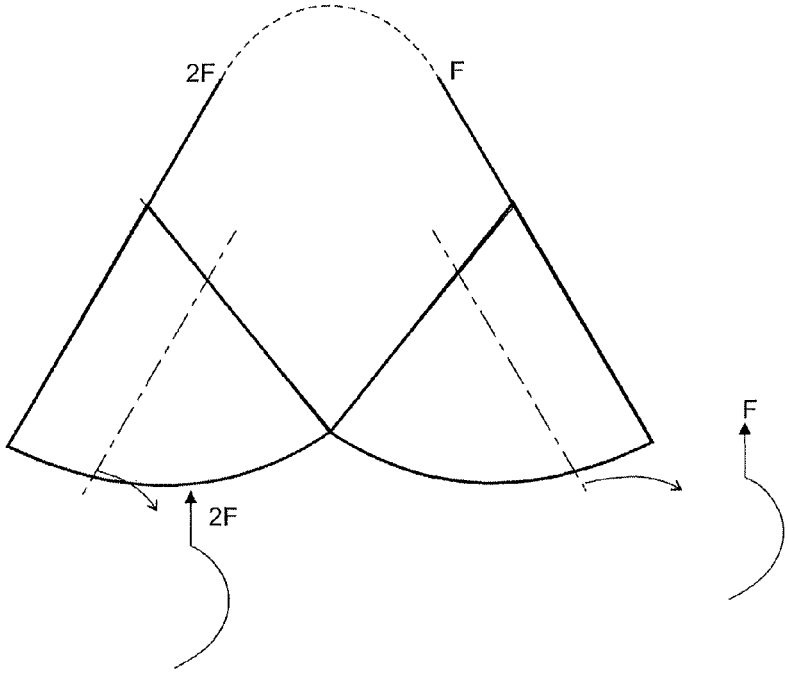
FIGURE 1b (Prior Art)
FIG. 1*b* is a front view of a partial bikini top.
Figure 1C:
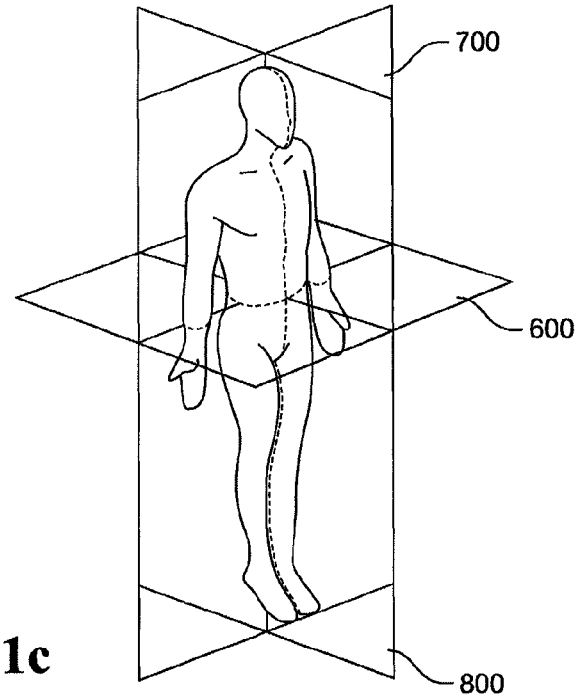
FIG. 1*c* is a view of a person to illustrate the Sagittal (800), Coronal (700) and Transverse (600) references planes of a human body.
Figure 1D:
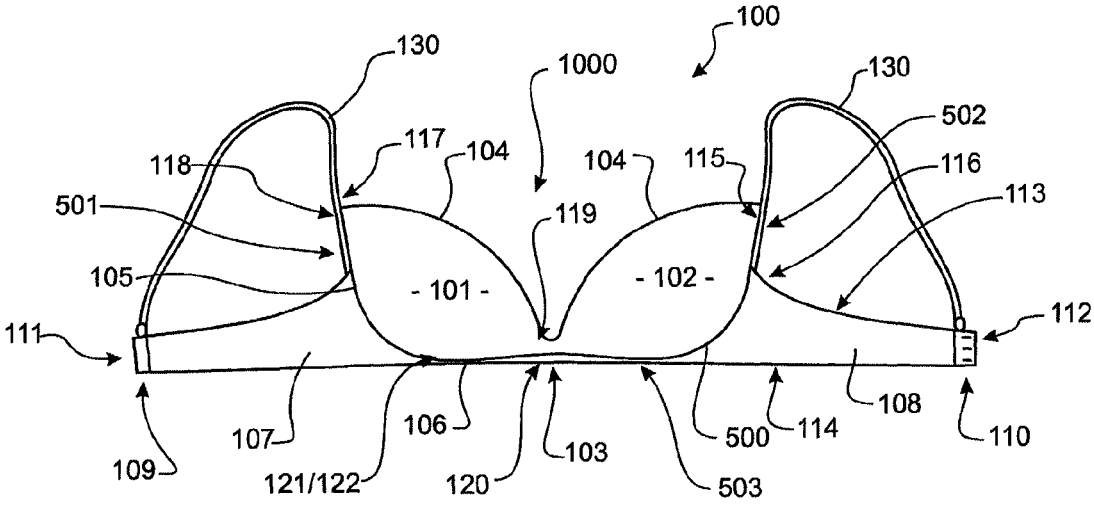
FIG. 1*d* is a front view of a bra of the present invention shown in a lay flat condition.
Figure 6:
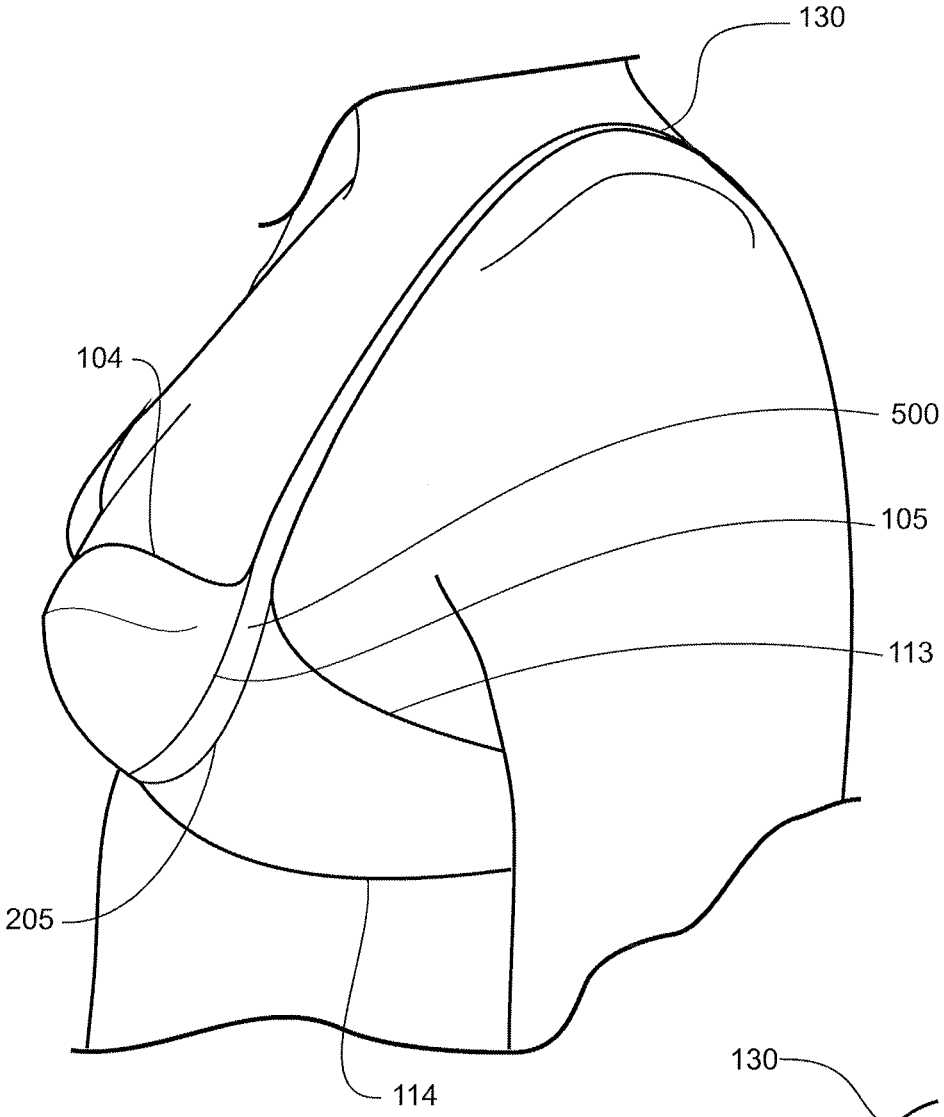
FIG. 6 is a side view of part of the upper body of a person wearing a bra of the present invention.
Figure 6A:
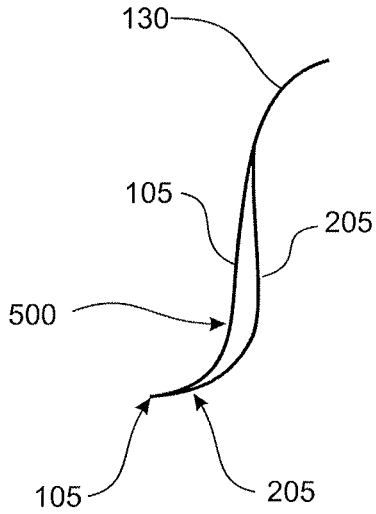
FIG. 6*a* is a side view of the perimeter band showing how in a preferred form its orientation changed from sitting against the body at or where it is the shoulder strap and projecting outwards from the body at the base of the bra.
Figure 7:
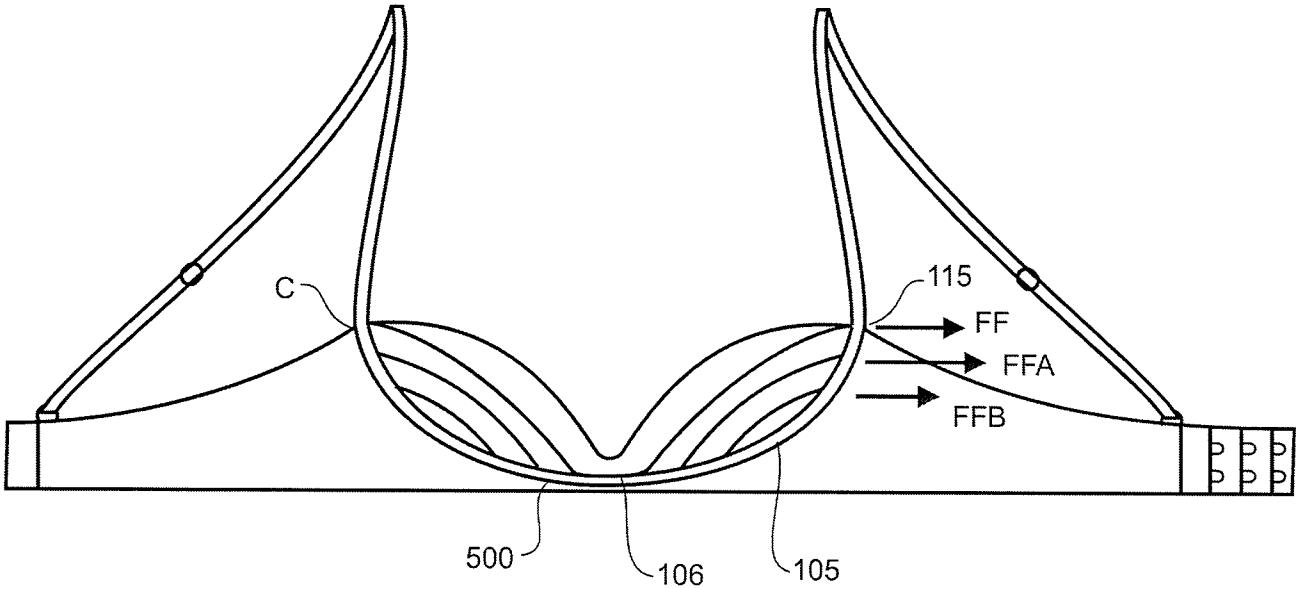
FIG. 7 is a front view of the bra of the present invention showing forces transferred to the chest band.
Figure 9:
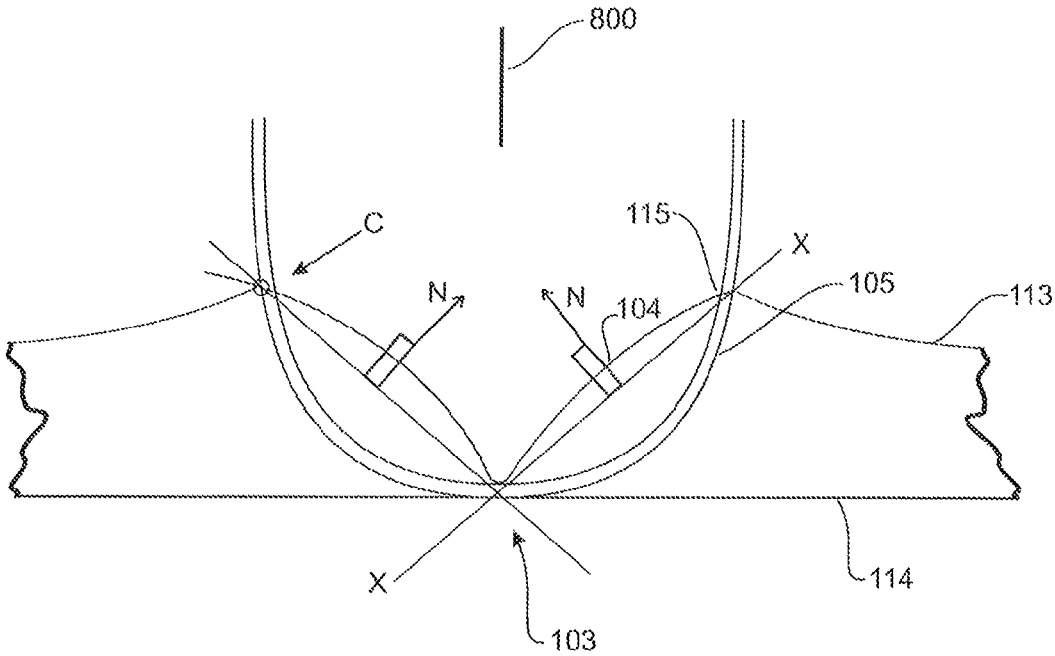
FIG. 9 shows force triangulation aspects of the bra.
Figure 10:
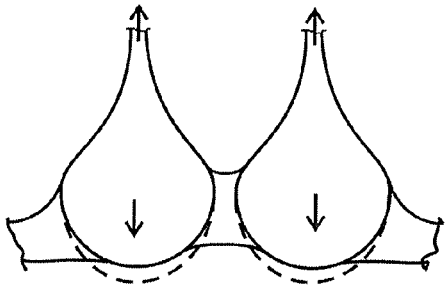
FIGURE 10 (Prior Art)
FIG. 10 is a front view of a prior art bra showing by way of phantom lines, how sag occurs when worn.
Figure 11:
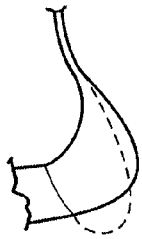
FIGURE 11 (Prior Art)
FIG. 11 is side view of the prior art bra of FIG. 10 with the phantom line showing the breast sag.
Figure 12:
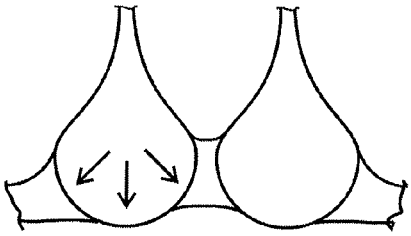
FIGURE 12 (Prior Art)
FIG. 12 is a front view of the prior art bra showing the radially outward pressures that are exerted on the breast cups by the weight of the breasts.

With reference to FIG. 1*d* there is shown a bra 100. The bra consists a breast containment zone 1000 that is located interior of a perimeter element 500. The perimeter element 500 may be a perimeter tape as shown in FIGS. 7 and 6 and 6*a*. It may instead be a line of stitching or made up of component parts to define two peripheral sides 501 and 502 and a base 503. The perimeter element is substantially "U" shaped and maybe a shallow "U" as shown in FIG. 1*d* or deep "U" as shown in FIG. 9. The base 503 may be straight, partially straight or curved.

Two breast cups 101 and 102 that are provided engaged to the perimeter element or each defining part of the perimeter element. The cups may be joined at a bridge region 103. The side perimeter of each cup is located/engaged at a peripheral edge of the perimeter element and the lower perimeter of each cup is located at the base of the perimeter element.

The or each of the breast cups may be made from a single ply or multiple overlying plies of material. Each ply may be stitched to adjacent plies to create shaping of the cups. Alternatively shaping of the cups may be defined by moulding of the ply or plies of material to the desired cup shape. The desired shaping, whether defined by affixing adjacent portions of a ply or plies of a material together such as by stitching or heat welding or similar, or whether defined by moulding of each of the breast cups, will hereinafter be described.

Each breast cup is substantially identical to the other. With reference to the breast cup 101 shown in FIG. 1*d*, each breast cup includes a neckline perimeter region 104, a side perimeter region 105 and a lower perimeter region 106. They preferably follow a continuous line together. The perimeter element preferably follows a continuous line. The shoulder strap take off point is directionally preferably also continuous with the upper end of the perimeter element. The take off point preferably is parallel to the sagittal plane, i.e. vertical when viewed from the front of the wearer.

With reference to FIG. 1*d* it can be seen that the side perimeter region 105 is preferably (at least not entirely) a free edge of the cup 101. A chest band 107 is attached or located and extends away from the breast cup 101, at at least part of its side perimeter 105 at the peripheral side 501 of the perimeter element 500.

The chest band may be one piece or made up of two chest band elements 107 and 108 and extend from a respective breast cup 101 and 102 and connect together in use, using clasps 111/112. Each chest band element is substantially elongate in nature and preferably each chest band element extends in a direction that is parallel to the other when the bra is in a natural lie flat condition as shown in FIG. 1*d*.

Figure 2:
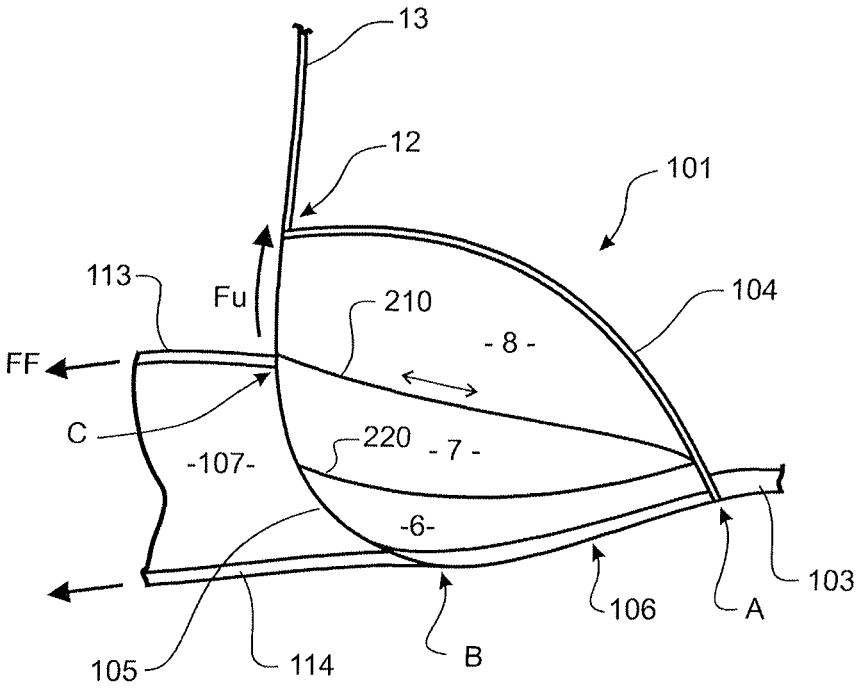
FIG. 2 is a front view of a cup of the bra of the present invention.

Each chest band element may also extend below a respective breast cup. As can be seen with reference to FIG. 1*d*, a small portion of the chest band extends below the lower perimeter 106 at the bridge region 103. Alternatively and as shown in FIG. 2, the lower portion 106 of the breast cup may provide this connection to the bridge 103.

Preferably each chest band element is identical except for, for example the clasps 109 and 110 located at the free distal ends 111 and 112 of each chest band 107/108 as shown in FIG. 1*d*.

With the chest band includes an upper perimeter 113 and a lower perimeter 114. A substantial part of the upper perimeter 113 extends substantially parallel to the elongate direction of the chest band. At regions of the upper perimeter 113 towards the breast cup 102, the perimeter may deviate from extending parallel to this elongate direction. Preferably the cup proximal end 116 of the upper perimeter 113 is located at or proximate the upper end 115 of the side perimeter region of the breast cup. However, alternatively the cup proximal end 116 may terminate at the side perimeter region of a breast cup at a point lower than the upper end 115 of the side perimeter region as shown in FIG. 1*d* and FIG. 2.

When the bra is in a lay flat condition the lower perimeter 114 of each chest band extends substantially horizontally. This can be seen in FIG. 1*d*. Preferably the lower perimeter 114 at the breast cups is substantially straight and extends substantially parallel, along its entire length, to the longitudinal direction of the chest band. In use it is located to be parallel to the transverse plane of the body of a wearer.

For convenience and as can be seen with reference to the above description, each cup can generally be described as a cup having three perimeter regions, a side perimeter, bottom or base perimeter and neck line perimeter.

With reference to the left hand side breast cup 101 of FIG. 1*d*, the neckline perimeter region 104 is preferably continuously curved. It has a first end 117 that terminates at the upper end 118 of the side perimeter region 105 of the breast cup. This may be coincident with where the upper edge 113 of the chest band engages with the side perimeter region 105 of the breast cup as shown in FIG. 6 or it may not be, as shown in FIG. 1*d*. The second end 119 of the neckline perimeter region 104 terminates at or near the inner end 120 of the lower perimeter region 106 of the breast cup.

Figure 3:
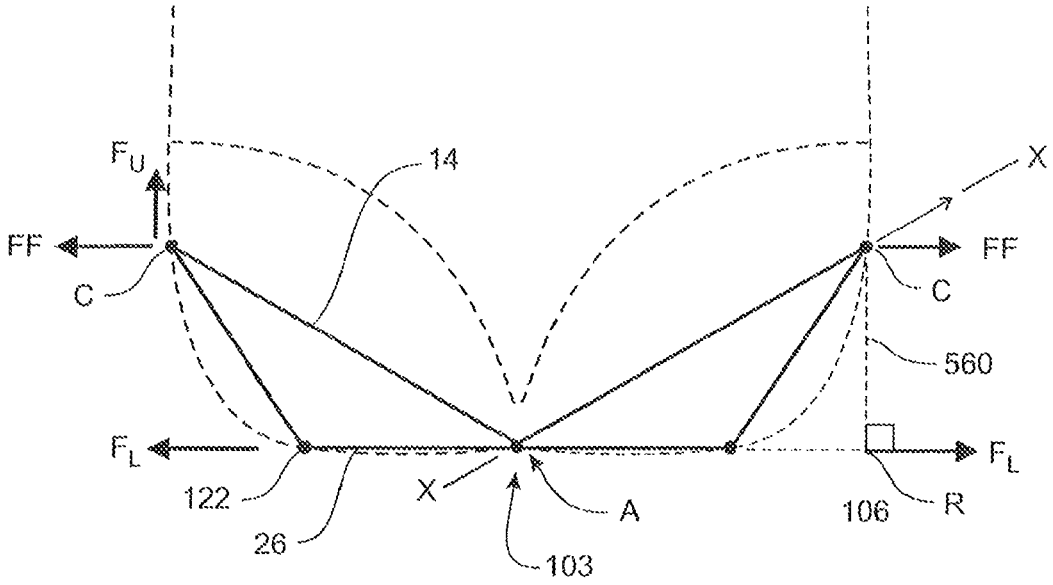
FIG. 3 is a view of the front of a bra of the present invention showing the forces at work that assist in creating a cantilevered effect of the breast cup.
Figure 4:
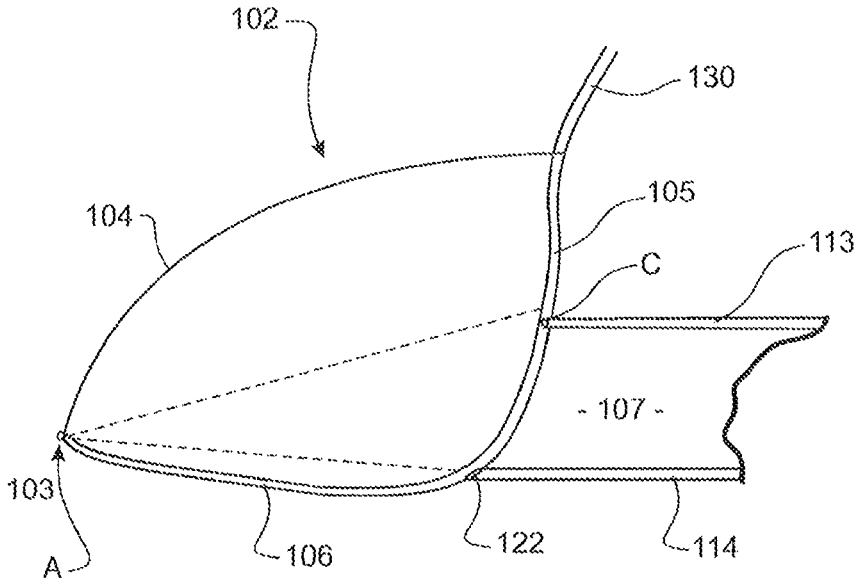
FIG. 4 illustrates the cantilever effect with focus one cup.

The lower perimeter region 106 has an outer end 121 that terminates at the lower end 122 of the side perimeter region 105. Preferably this is at where the lower edge 114 of the chest band engages to the breast cup. As can be seen in FIG. 1*d*, no part of the breast cup preferably sits below the line between 103 and 122. In FIGS. 3 and 4, minimal or no cup volume can be seen to be located below the line. Breast volume sitting below this line may not contribute to the uplift and cleavage production. Hence the preference that little volume of breast is located below the line between 103 and 122 and the bra is constructed and shaped accordingly.

Preferably the transition between the lower perimeter region 106 and the side perimeter region 105 of the cup may be continuous rather than having an apexed or angled change.

Figure 8:
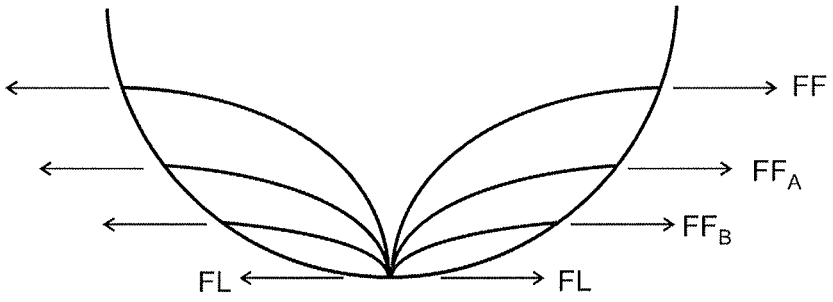
FIG. 8 shows a cup zone having two breast cups where multiple lines of inelasticity extend across the cups and how such the forces in such are transferred at multiple locations to the chest band.

The side perimeter 105 is substantially and preferably continuously curved although some straight portions may be included at or near for example the upper end 118 and/or at bottom 103. Indeed the perimeter of the breast cup defined by the side perimeter region 105 and lower perimeter region 106 may be continuously curved from the inner end 120 to the upper end 118. In the lie flat condition the lower perimeter region 106 of the bra extends substantially parallel to the longitudinal direction of the chest straps 107 and 108. In the example shown in FIG. 1*d*, the lower perimeter region 106 extends substantially parallel to the lower perimeter 114 of each of the chest straps. The outer end 121 of the lower perimeter region 106 terminates at a point that is substantially no higher in a vertical direction than the inner end 120 of the lower perimeter region 106. This allows for a direct line of force F1 to be applied through the bottom of the bra as shown in FIGS. 3 and 8. The lower perimeter 114 of the chest band is (or is of a zone or region) that is preferably inelastic or substantially non-stretch in nature to facilitate this. Alternatively it may be reliantly stretchable. The lower perimeter 114 of the chest band defines such a zone to allow a location of the bra about the torso of the wearer and to provide the base a base line of a notional triangulation of forces created during the wearing of the bra.

The end 119 of each breast cup preferably terminates at the bridge region 103. Such termination may be at or proximate to the inner end 120 of the lower perimeter region 106 or may be away therefrom.

Figure 5:
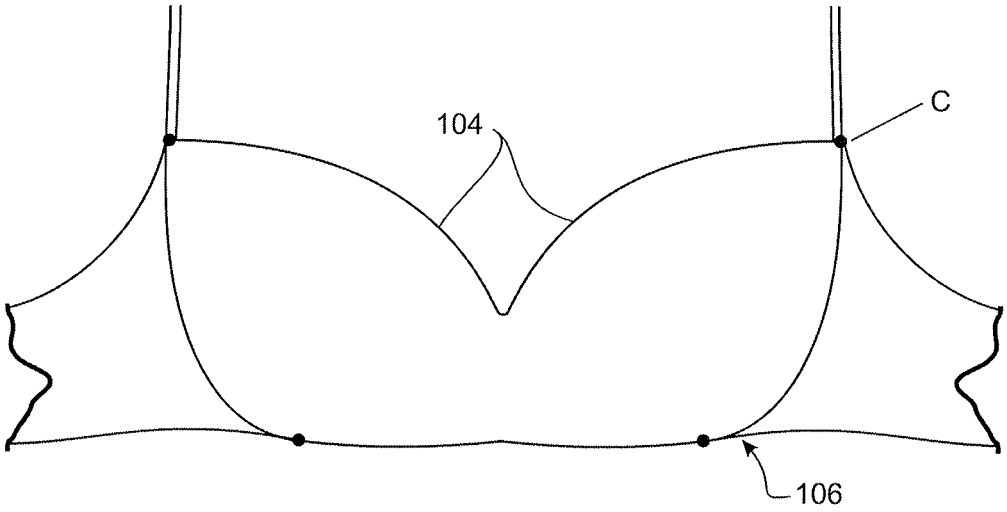
FIG. 5 is a front view of part of a bra of the present invention.

With reference to FIG. 1*d*, it can be seen that the bra has a substantially deep V shaped neckline perimeter. However where such a neckline perimeter is more shallow, the inner end 119 of the neckline perimeter 104 may terminate well above the inner end 120 of the lower perimeter region 106. A variation like that is shown in FIG. 5.

At or near the upper end 118 of the side perimeter region 105, there is affixed an over the shoulder strap 130. The shoulder strap 130 is preferably attached or affixed to be engaged to either the breast cup 101 or the chest band 107, or both, or an extension thereof. The shoulder straps, in use, do not take much force. The shoulder straps are preferably continuous with the perimeter of the perimeter of the cups and the perimeter element 500 and provide a location function for the bra on the body of the wearer rather than a breast support function.

The chest band is preferably of a flexible material or materials but is preferably non elastic. The chest band may consist of a ply of fabric material or multiple overlying plies of fabric material. Part or all of the plies of the chest band may be continuous with the ply or plies of material of the adjacent breast cup. For example where a bra of the present invention is made by moulding techniques, overlying plies of material may extend across at least part or all of each of the breast cups and chest bands.

Each breast cup may preferably consist of a plurality of panels as shown in FIG. 2. Each panel may be joined together by lines of stitching 210/220 or other modes of engagement. With reference to FIG. 7, it can be seen that each of the lines may terminate at the lower perimeter region 106 or bridge region 103 of the breast cup and the opposite ends terminate at the side perimeter region 105 and/or or at the upper end of the side perimeter line. Most preferably each of the inner distal ends of the lines either terminate at the bridge 103 (preferably one of the cup lines does) or at the lower perimeter 106.

Figure 7A:
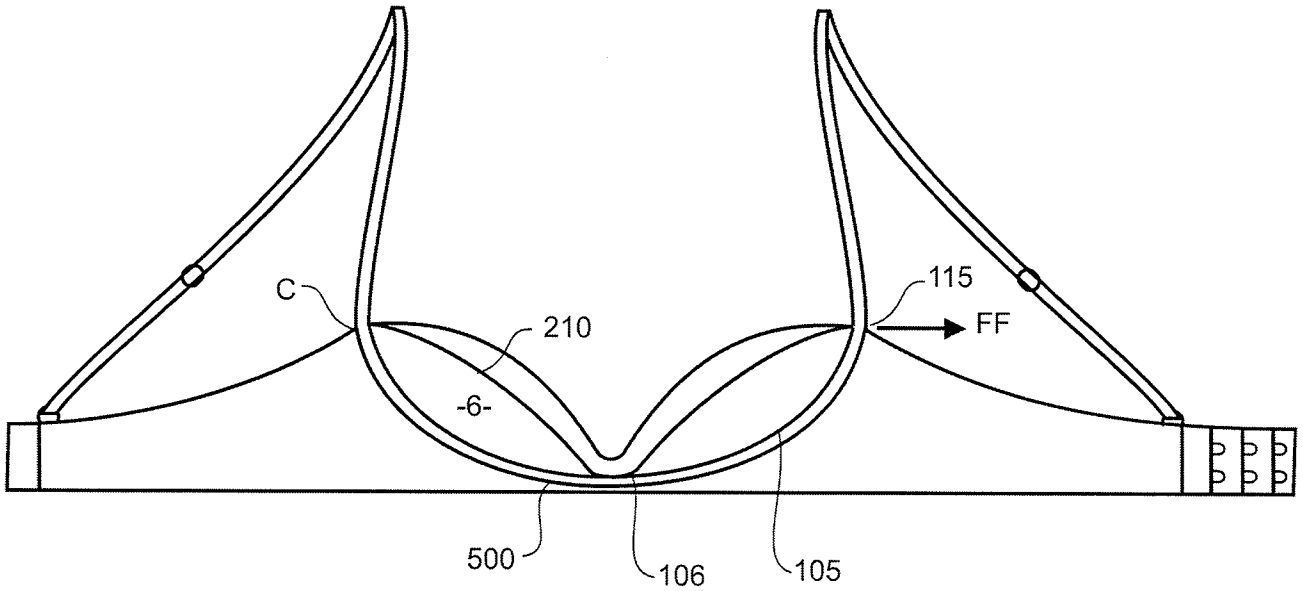
FIG. 7*a* shows a front view of a bra or the preferred form of the present invention where the primary cup line extends from the base of the U-shaped perimeter element to a location coincident with the U-shaped perimeter element at where the shoulder strap is engaged and a part (preferably the upper edge) of the chest band is engaged.

In the most preferred form of the bra as shown in FIG. 7*a*, the lowest cupline (which may be the only cup line and may be the neck line (not shown) or a line running across the cup as shown) extends from the base of the perimeter element 500, preferably at of close to the centre of the bra, to its other end, coincident at point C where it is at the terminal end of the perimeter element 500 and where the take off point of the shoulder strap is and also where the chest band is engaged to the perimeter element. Preferably the upper edge 113 of the chest band is coincident at this point C. Point C is preferably also the upper most part of the cup when worn.

As shown in FIG. 9, the line N that may be dawn extending normal from a line between point C and 103 slopes inwardly toward the sagittal plane of the person and upwards. This helps hold the breasts inwardly when the bra is being worn. In addition, the line N is preferably parallel to a line of symmetry of at least that part of the cup that is located between the line running from point C to 103 and the perimeter element 500.

The chest band preferably includes an upper more zone that can transmit a force FF acting parallel to a transverse plane of the wearer. This zone is either in-elastic or may be resiliently stretchable and is preferably defined by the upper most perimeter 113 of the chest band. The zone may be as a result of a line of inelasticity or resilience as a result of the use of specific material of the chest band. The force FF may be a component of force that is vectored in a direction out of being parallel to the transverse plane, but such a force will have a component acting in direction FF as for example shown in FIG. 8.

Additional forces parallel to FF may act on the side perimeter 105 of each cup. Such forces FFa and FFb may act at locations corresponding to where the cup lines of inelasticity 210 and 220 respectively are provided.

As well as providing lines of inelasticity (cuplines) extending across each of the breast cups, the cuplines may simultaneously provide shaping of the cup.

Where the breast cups comprises of a plurality of panels such as panels 6, 7, 8 at where each of the panels is joined to an adjacent panel the nature of the perimeter of the panels may be such as to create a shaping of the cup. Such shaping may be akin to the shaping as described in PCT application PCT/NZ01/00175 which is hereby incorporated by way of reference.

Where the breast cup is defined by a moulding of plies of material such shaping can be introduced by moulding of the materials.

In the preferred form lines of inelasticity are established at least across some of or all of the breast cup so as to assist in the transfer of forces as described. In a moulded version of the cup the lines of inelasticity may be defined by additional components that may be introduced intermediate of plies of material defining the breast cups or may be defined by additional moulding or heat treatment of at least one of the plies so as to rigidify part of the ply. In a moulded bra such lines of rigidity may instead or also be incorporated by stitching across the cup along at where the lines of rigidity are to be provided.

Figure 8A:
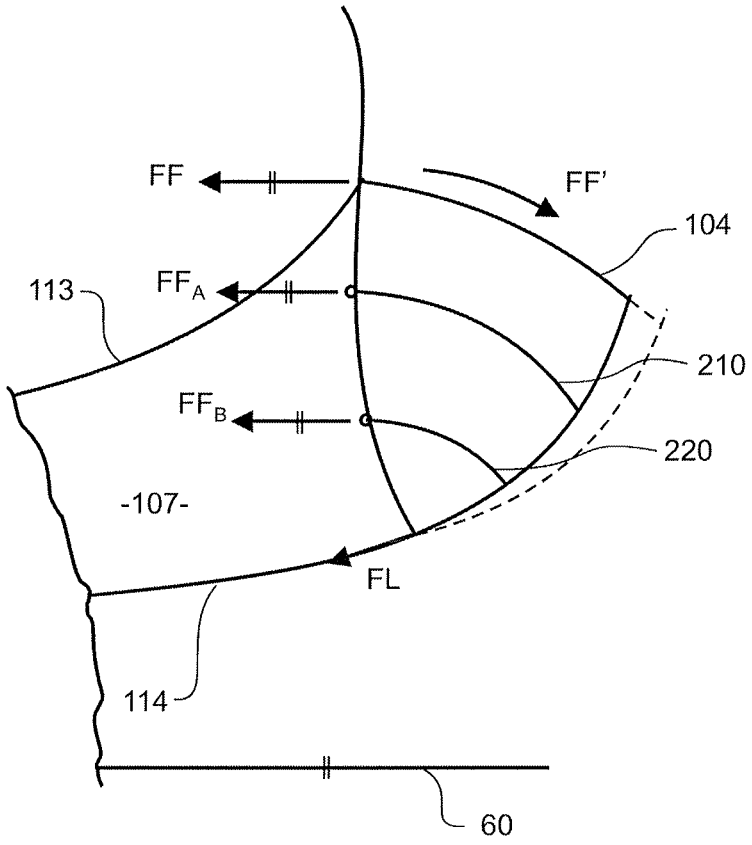
FIG. 8*a* is a side view of a cup and part of a chest band showing the transfer of forces from the cups lines of inelasticity to multiple parts of the chest band.

As can be seen in FIG. 8*a*, the lines of inelasticity help retain cup shape by virtue of creating a path via which forces due to the weight of the breasts can be transferred to the chest band at locations of the chest band above the lower perimeter of the chest band. Sag of the cup may otherwise occur as shown by way of a phantom outline of the cup in FIG. 8*a*. The bra of the present invention can enhance cleavage and/or uplift as a result of a combination of the features.

Cup shaping, including the lines of inelasticity extending at least in part across each of the cups will help in displacement of breast tissue in an upward direction (and may also be in an inward direction) as well as facilitate the transmission of forces to at least the upper most edge of the chest band for the purposes of uplifting of the breasts.

The line of inelasticity in conjunction with a straight lower perimeter chest band in conjunction with the side perimeter regions and/or the cup lines can help create uplift and/or cleavage.

With reference to FIGS. 7 and 9 for example, it can be seen that the perimeter element form effectively a "mono curve". This mono curve or at least that part thereof commensurate with the chest band create a cradle or sling like support for the bust as a whole rather than two separate support structures as in a conventional construction. This allows for the whole of the bust to be supported whilst allowing natural bust movement. Whilst the bust "floats" in a supported state, the shape of the chest band feels like a glove that moves with the wearer. It stays in place which should eliminate any riding up issues. The shoulder straps on the bra do not need to be pulled tight. This minimises shoulder pressure and allows more appropriate strap position. Cup support is instead predominantly provided by the chest band and the fact that for FF is taken up by the chest band at a height above where force FL acts.

These aspects allows both breast to be controlled for shape as a whole rather than constraining each breast in separate and independent cup forms. This means that shaping and sizing of each breast cup need not be accurate to a specific person's breast size in order to provide comfortable support and uplift. A person with an in between breast cup size can comfortable and aesthetically wear the bra and the bra. The bra is forgiving in shape to allow such to be achieved.

The perimeter element is of a U or flattened U-shape. It is preferably continuously curved and extends from the shoulder straps and forms the side and lower boundary of the bra cups. This assists in keeping the breasts inwards towards each other.

Figure 13:
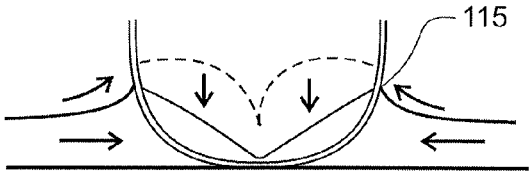
FIG. 13 shows a front view of the bra of the present invention and wherein the breasts (shown in phantom) exert a downward pressure on the cups that by virtue of forces of the cups working in combination with the chest bands, support the breasts in a cantilevered manner.
Figure 14:
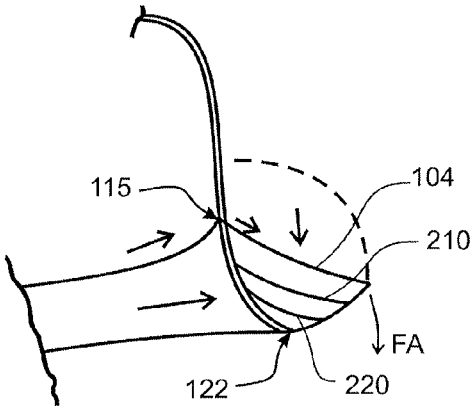
FIG. 14 is a side view of the bra of the present invention showing the cantilevered effect.
Figure 15:
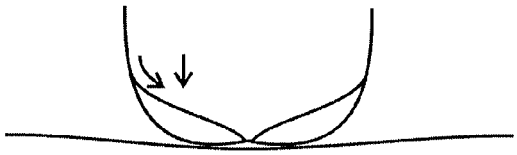
FIG. 15 is a front view showing forces at work when the bra of the present invention is being worn.

A notional axis XX is defined by a line between the uppermost cup attachment point at where the upper edge 113 of the chest band engages the side perimeter 105 of the cup as per FIGS. 3 and 9. This is preferably also coincident at or near to where the shoulder strap is engaged to the cup and at the upper most point of the cup. The axis XX of each breast cup is angled so as to contain the breast volume upwards and centrally Triangulation creates the cantilever arrangement of the bra. This is the effect that loads on the bra cups (support) and transfers this load to the upper edge of the chest band as shown in FIGS. 13 and 14. The force FA acting on the cup due to the weight of the breast is transmitted to the point 115 and then along the upper perimeter 113 of the chest band as shown in FIG. 9. This resists the tendency for the breast to drop over the perimeter of the cups as is common in prior art bras.

The lines 210/220 and cups shaping of the lower area of the cups helps support the breasts as shown in FIG. 14.

Because the cups have a primary axis sloping toward the central point of the bra a displacement occurs of the breasts both together and upwards. The triangulation of the bra allows forces related to displacement to be borne as increased tension in the chest band of the wearer and reduces reliance on the tensioning of the shoulder straps for increased uplift and support. If the cup was attached higher than the upper edge of the chest strap and/or the chest band was not positioned for triangulation, then increased loads would be placed on the shoulder straps. In the preferred form of the invention, the distance between points C and R along line 560 is preferably no less than 50% of the distance between point R and A. Line 560 extends at 90 degrees to where base line force FL is applied and passed through point C as shown in FIG. 3. If point C is too close to point R then the ability for the upper edge of the chest band to resist the force on the cup due to breast weight, quickly diminishes.

The bra utilises specifically shaped sections of fabric, either created from flat pieces of fabric (darts) or moulded into shape. The lowest section 6 of fabric is utilised to support the breast in a shelf or sling arrangement between a connection at the sternum and connection to the chest band. This arrangement, when encapsulating the breast, acts as a cantilever such that the downward force on the breast (caused by uplift) is countered by the chest band of the bra frame. Further sections 7, 8 etc of the fabric complete the bra cup to provide continuous and natural curvature over the bra cup surface when worn.

The shape of the breast cup is not hemispherical and is designed to provide a natural shape when worn. The shape minimises the degree of overlap of the breast tissue onto the torso and provides a resilient boundary layer on which the soft breast tissue is located.

The framework of the bra is different from conventional bra's at least because of the way the lowest panel 6 of each cup is integrated into the continuous flattened U shape cup perimeter line, and the line of symmetry of each cup is orientated towards the sagittal plane 800 (i.e. it is parallel to line N) as seen in FIG. 7*a*.

To achieve a natural shaped bust line, symmetry of each cup does not exist about a plane parallel to the sagittal plane 800. The invention avoids the need to tension the shoulder straps of the bra to achieve uplift, which also avoids shaping issues associated with compression and posture issues created by increased shoulder loads. Hence the force Fu in the shoulder straps is negligible and provided primarily for bra location purposes rather than support purposes.

The invention claimed is:

1. A bra that comprises:

a breast containment zone that is defined by two breast cups that are engaged to a perimeter element, the perimeter element comprising a base perimeter and two peripheral side perimeters extending from each side of the base perimeter and forming a "U" shape that extends about the base perimeter and side perimeter of each breast cup, an elongate chest band that is engaged to and extends bilaterally away from the perimeter element at each breast cup, to encompass the torso of a wearer, the chest band comprising:

(a) a lower elongate zone to apply a first force to said perimeter element in a direction parallel to a transverse plane of the body of the wearer at the base perimeter of the perimeter element, and (b) an upper elongate zone to apply a second force adjacent each breast cup to said perimeter element in a direction parallel to a transverse plane of the body of the wearer at the each peripheral side of the perimeter element and at a distance away from said base perimeter of the perimeter element, wherein each breast cup includes a line of inelasticity that extends:

i. from where said second force is applied to said breast cup, ii. to the base perimeter of the perimeter element.

2. The bra as claimed in claim 1 wherein each perimeter element is engaged, at an upper end of each of its peripheral side perimeters, to an over the shoulder strap.

3. The bra as claimed in claim 1 wherein the upper most part of each breast cup terminates at an upper end of each peripheral side perimeter of the perimeter element.

4. The bra as claimed in claim 1 wherein the upper elongate zone terminates at each said peripheral side of the perimeter element at where the upper most part of each breast cup is engaged to said perimeter element.

5. The bra as claimed in claim 1 wherein the "U" shaped element is a perimeter band.

6. The bra as claimed in claim 1 wherein the lower zone is a lower perimeter of the chest band that extends parallel to said transverse plane, at least at said base perimeter of said perimeter element, and entirely along said base perimeter's entire length.

7. The bra as claimed in claim 1 wherein the upper zone is an upper perimeter of the chest band.

8. The bra as claimed in claim 1 wherein the chest band is resilient to forces applied thereto by virtue of breast weight carried by the cup at which the chest band is engaged.

9. The bra as claimed in claim 1 wherein the upper zone is not linear but is capable of applying said second force in a direction parallel to the transverse plane.

10. The bra as claimed in claim 1 wherein the lower elongate perimeter of the chest band engages to the perimeter element tangentially.

11. The bra as claimed in claim 1 wherein each breast cup includes a. a lower perimeter region engaged to the base perimeter of said perimeter element, b. a side perimeter region engaged to a peripheral side of the perimeter element, and c. a neckline perimeter region, the neckline perimeter region extends between i. a first distal end, which is an inner end, of the lower perimeter region or proximate thereto and ii. a first distal end, which is an upper end, of the side perimeter region, wherein the lower perimeter region and side perimeter region are coterminous each other.

12. The bra as claimed in claim 11 wherein for each breast cup, the second end of the lower perimeter region is located at less than half way from the inner end to a point on the lower perimeter region of the chest band at which a normal thereof lies in a plane that extends through the upper end.

13. The bra as claimed in claim 1 wherein each breast cup has at least one-line of inelasticity that extends (across each breast cup, but alternatively defining the neckline, such line extending from the base perimeter of said perimeter element to a peripheral side of said perimeter element.

14. The bra as claimed in claim 13 wherein said cup line has a normal that defines a line of symmetry of at least that part of said cup that is located between said cupline and the perimeter element.

15. The bra as claimed in claim 1 wherein a notional line between (a) the location of where the upper edge of the chest band is engaged to the perimeter element and (b) the bra midpoint at the perimeter element, has a normal that defines a line of symmetry of at least that part of said cup that is located between said notional line and the perimeter element.

16. The bra as claimed in claim 13 wherein said cupline of inelasticity extends to define one side of a triangle of a triangulation of forces, when views from a posterior direction towards the wearer, extending between:

the first end of the lower perimeter region of the breast cup and the upper end of the side perimeter region of the breast cup, and the first end of the lower perimeter region of the breast cup and the second end thereof, and the second end of the lower perimeter region of the breast cup and upper end of the side perimeter region.

17. The bra as claimed in claim 1 wherein no part of each cup extends below the base perimeter of the perimeter element.

18. The bra as claimed in claim 1 wherein the distance between (a) a notional point on the lower perimeter of the chest band and (b) a point at which the upper inelastic zone engages said perimeter element, along a line normal to the lower perimeter region, is no less than 50% of the distance between (a) said notional point and (b) a point on the lower perimeter of the chest band that is located midway the base perimeter of said perimeter element.

* * * * *